US005954288A

United States Patent [19]

Shih

[11] Patent Number: 5,954,288

[45] Date of Patent: Sep. 21, 1999

[54] EXTENSIBLE HANGING DEVICE

[76] Inventor: Yung-Le Shih, No.7, Lane 65, Kuang Hwa Road, Lu Chou City, Taipei Hsien, Taiwan

[21] Appl. No.: 09/138,126

[22] Filed: Aug. 24, 1998

[51] Int. Cl.[6] ..... B65H 75/48

[52] U.S. Cl. ..... 242/380; 70/456 R

[58] Field of Search ..... 242/380, 402; 33/413, 414, 756, 767; 70/456 R; 119/796; 248/329, 330.1

[56] References Cited

U.S. PATENT DOCUMENTS

| | | | |
|---|---|---|---|
| 1,043,092 | 11/1912 | Goodwin | 242/380 |
| 2,713,407 | 7/1955 | Miller | 242/380 |
| 3,020,001 | 2/1962 | Fischbein | 242/380 |
| 3,041,044 | 6/1962 | Nixon | 242/380 |
| 3,968,670 | 7/1976 | Quenot | 242/380 |
| 3,982,613 | 9/1976 | Wood | 242/380 |
| 5,833,165 | 11/1998 | Paugh | 242/380 |

*Primary Examiner*—John M. Jillions

*Attorney, Agent, or Firm*—Smith, Gambrell & Russell; Beveridge, DeGrandi, Weilacher & Young Intellectual Property Group

[57] ABSTRACT

An extensible hanging device includes a casing holding a winding mechanism controlled reversible cord member, a clip fixedly secured to the casinig at a back side for fastening, a ring for holding personal items, and a connector connected between the ring and the cord member outside the casing, the connector having a spherical knob fixedly connected to the cord member, the clip having a location frame at a bottom side of a fixed end thereof for holding the spherical knob of the connector in place, the locating frame having a longitudinal narrow slot, which allows the neck of the spherical knob to pass, and an expanded front opening, which allows the spherical knob to pass and to be rested on the inside of the location frame.

3 Claims, 9 Drawing Sheets

EXTENSIBLE HANGING DEVICE

BACKGROUND OF THE INVENTION

The present invention relates to an extensible hanging device for holding personal items such as keys, mini hand tools, etc., and more particularly to such an extensible hanging device which has clip means for fastening to for example the user's waist belt, a ring for holding personal items, and locating means for holding the ring in place.

FIG. 1 shows an extensible hanging device according to the prior art. This structure of hanging device comprises a circular casing holding a winding mechanism on the inside, a cord member connected to the winding mechanism and extended out of the casing, stop means fixedly fastened to the outer end of the cord member to stop the outer end of the cord member from being received inside the casings and a ring fastened to the stop means outside the casing for holding a bunch of keys, mini hand tools, small personal items, etc. This structure of hanging device is still not satisfactory in function. When a bunch of keys or several mini hand tools arc hung on the ring and the casing is fastened to the user's waist belt, the cord member may be pulled out of the casing at a distance, causing the hung items to swing when the user walks.

SUMMARY OF THE INVENTION

The present invention has been accomplished to provide an extensible hanging device which eliminates the aforesaid problem. According to the present invention, the extensible hanging device comprises a casing holding a winding mechanism controlled reversible cord member, a clip fixedly secured to the casing at a back side for fastening a ring for holding personal items, and a connector connected between the ring and the cord member outside the casing, the connector having a spherical knob fixedly connected to the cord member, the clip having a locating frame at a bottom side of a fixed end thereof for holding the spherical knob of the connector in place, the locating frame having a longitudinal narrow slot, which allows the neck of the spherical knob to pass, and an expanded front opening, which allows the spherical knob to pass and to be rested on a recessed portion around the rear end of the longitudinal narrow slot inside the locating frame. When the clip is fastened to for example the user's waist belt, the spherical knob is rested on the recessed portion inside the locating frame, and therefore the hung items call be held in place.

DETAILED DESCRIPTION OF THE PREFERRED EMBODIMENT

Figure 1:
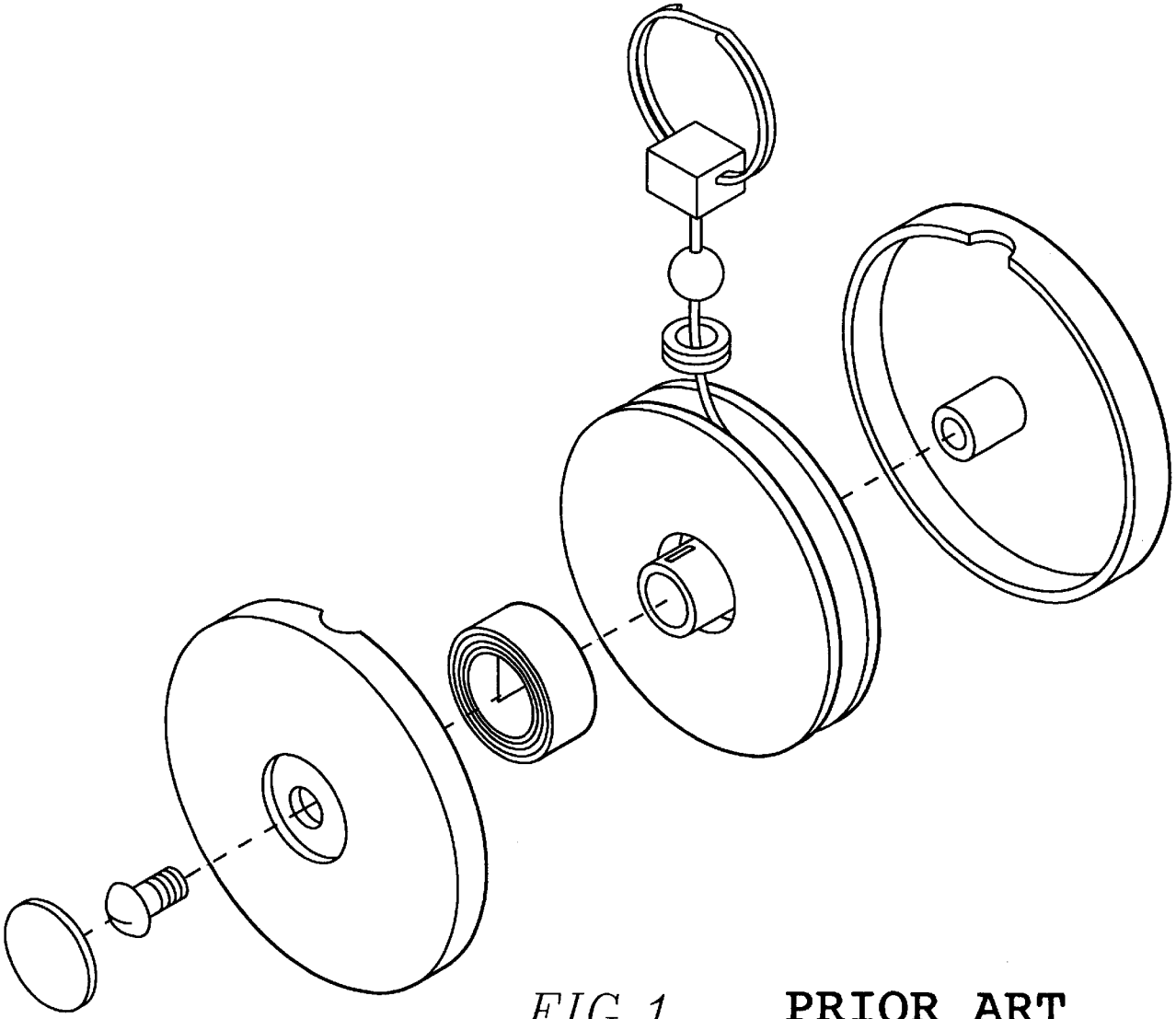
FIG. 1 PRIOR ART
FIG. 1 is an exploded view of an extensible hanging device according to the prior art.
Figure 2:
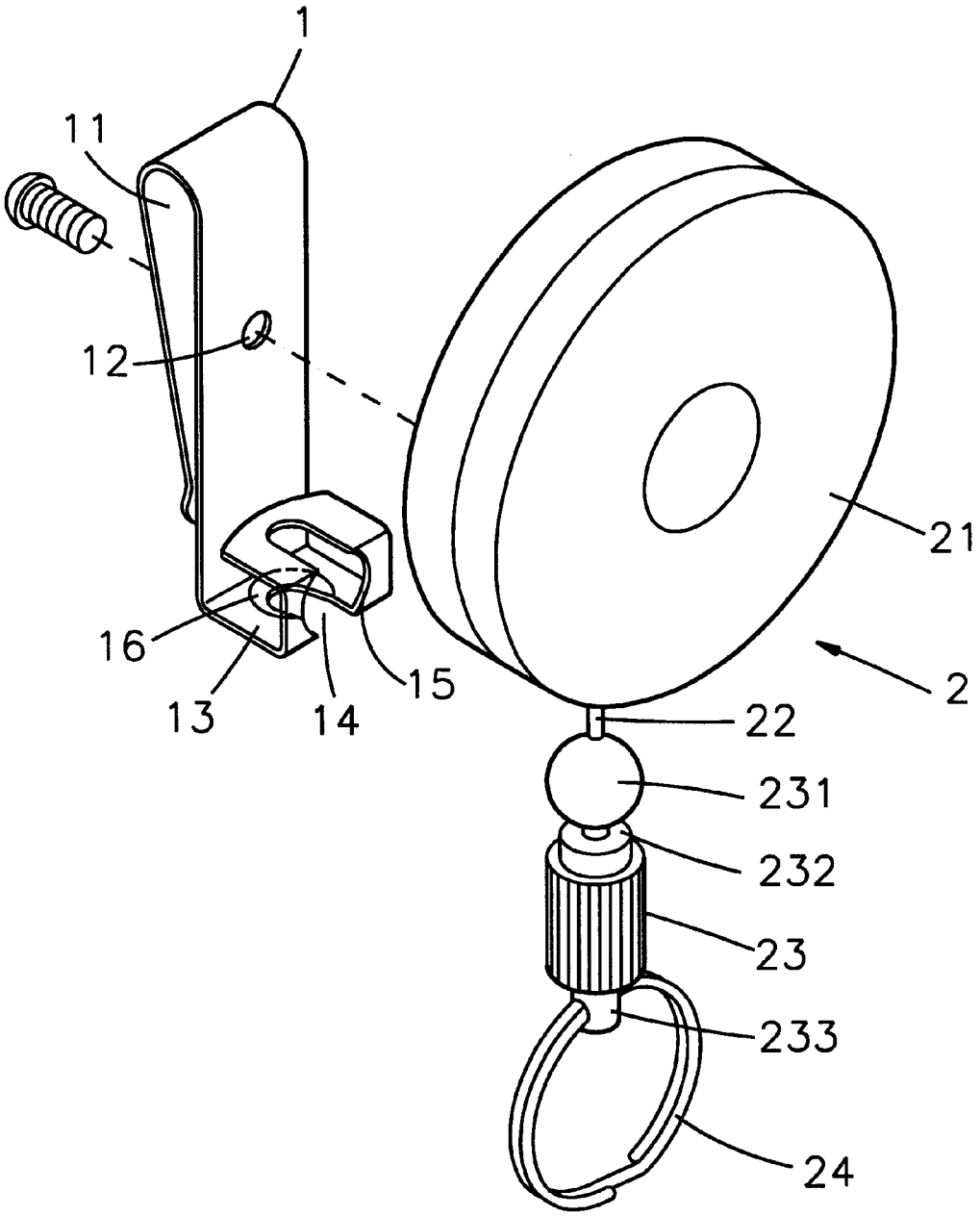
FIG. 2 is an exploded view of an extensible hanging device according to the present invention.

Referring to FIG. 1, an extensible hanging device in accordance with the present invention is generally comprised of a clip 1, and a body 2. The clip 1 is made by bending a stamped metal plate into shape, comprising a rear clamping plate 11 for securing the clip to for example the user's waist belt, a front mounting hole 12 on the middle, and a forwardly extended bottom locating frame 13. The forwardly extended bottom locating frame 13 comprises a longitudinal narrow slot 14, an expanded opening 15 at the front side of the longitudinal narrow slot 14, and a recessed portion 16 around the rear end of the longitudinal narrow slot 14. The body 2 comprises a circular casing 21 holding a winding mechanism (not shown) on the inside a reversible cord member 22 having an inner end fastened to the winding mechanism inside the casing 21 and an outer end extended out of the casing 21, a rind 24, and a connector 23 connected between the ring 24 and the outer end of the reversible cord 22. The connector 23 comprises a spherical knob 231 at one end, and an eye rod 233 at an opposite end. The spherical knob 231 is fixedly connected to the outer end of the reversible cord 22, having a neck 232 extended from a part of the connector 23. The ring 24 is fastened to the eye rod 233 of the connector 23.

Figure 3:
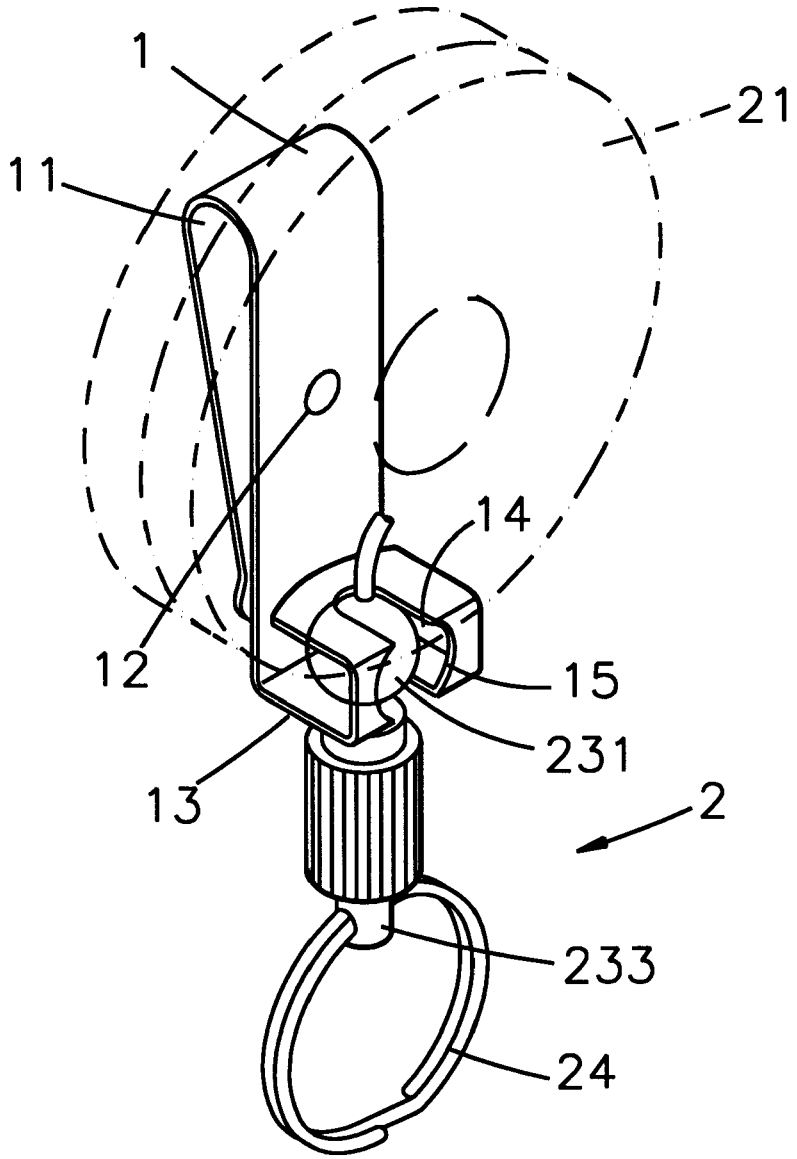
FIG. 3 is a perspective assembly view of the extensible hanging device according to the present invention.
Figure 4:
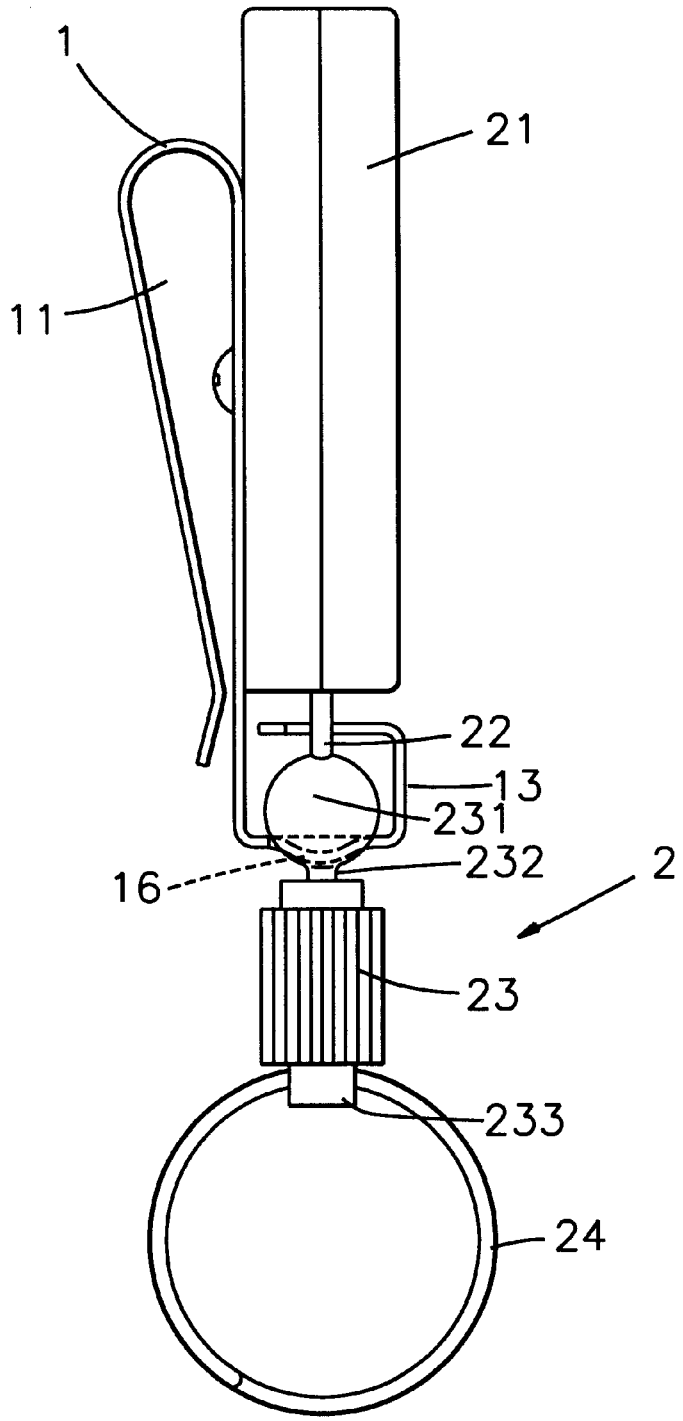
FIG. 4 is a side view of the extensible hanging device according to the present invention.

Referring to FIGS. 3 and 4, a screw is inserted through the mounting hole 12 and threaded into a screw hole (not shown) at the back side wall of the casing 21 to fix the clip 1 to the casing 21. After the clip 1 and the casing 21 have been fastened together, the spherical knob 231 can be inserted through the expanded front opening 15, and then rested on the recessed portion 16. When the spherical knob 231 is inserted into the expanded front opening 15, the neck 232 is moved with the spherical knob 231 through the longitudinal narrow slot 14, enabling the spherical knob 231 to be rested on the recessed portion 16.

Figure 5:
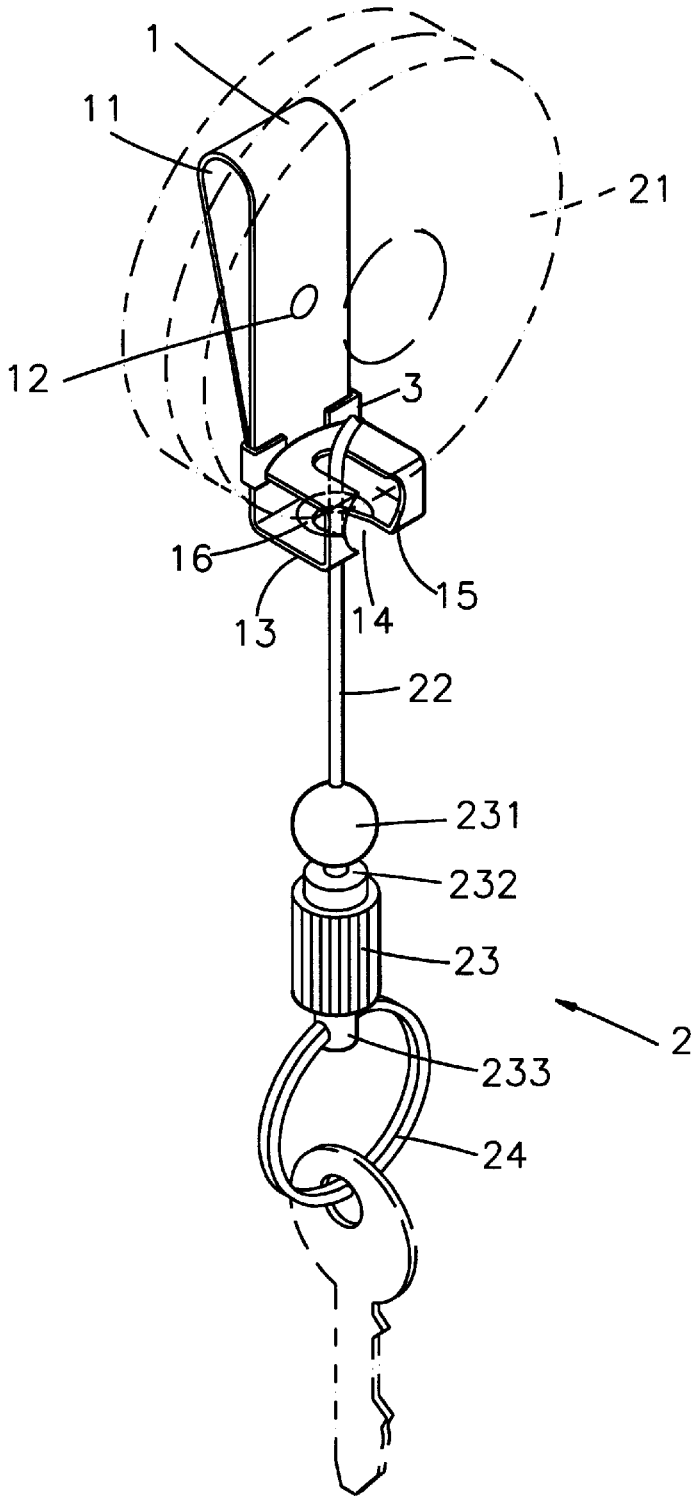
FIG. 5 is an applied view of the present invention, showing a key hung on the ring of the extensible hanging device.
Figure 6:
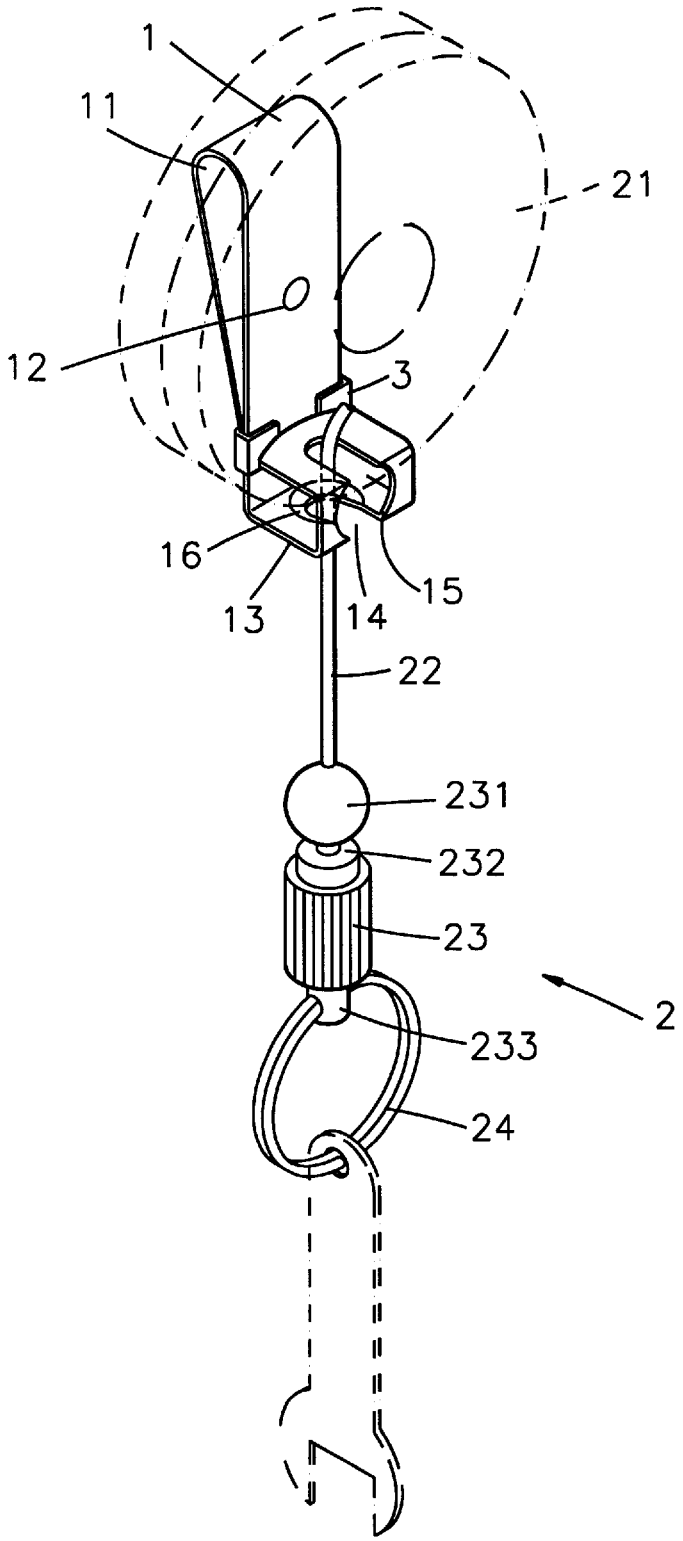
FIG. 6 is another applied view of the present invention, showing a hand tool hung on the ring of the extensible hanging device.

Referring to FIGS. 5 and 6, keys, mini hand tools (screwdrivers, spanners, pliers, etc.), or small personal items can be hung on the ring 24, and the clip 1 can be fastened to one's waist belt.

Referring to FIGS. from 3 through 6 again, when in use, the knob 231 is moved out of the expanded front opening 15, and the hung item for example a key that is hung on the ring 24 can be directly moved with the hand to pull the reversible cord 22 out of the casing 21, enabling the key to reach and open the lock. Therefore, the user needs not to disconnect the clip 1 from the waist belt when using a device hung on the ring 24.

Figure 7:
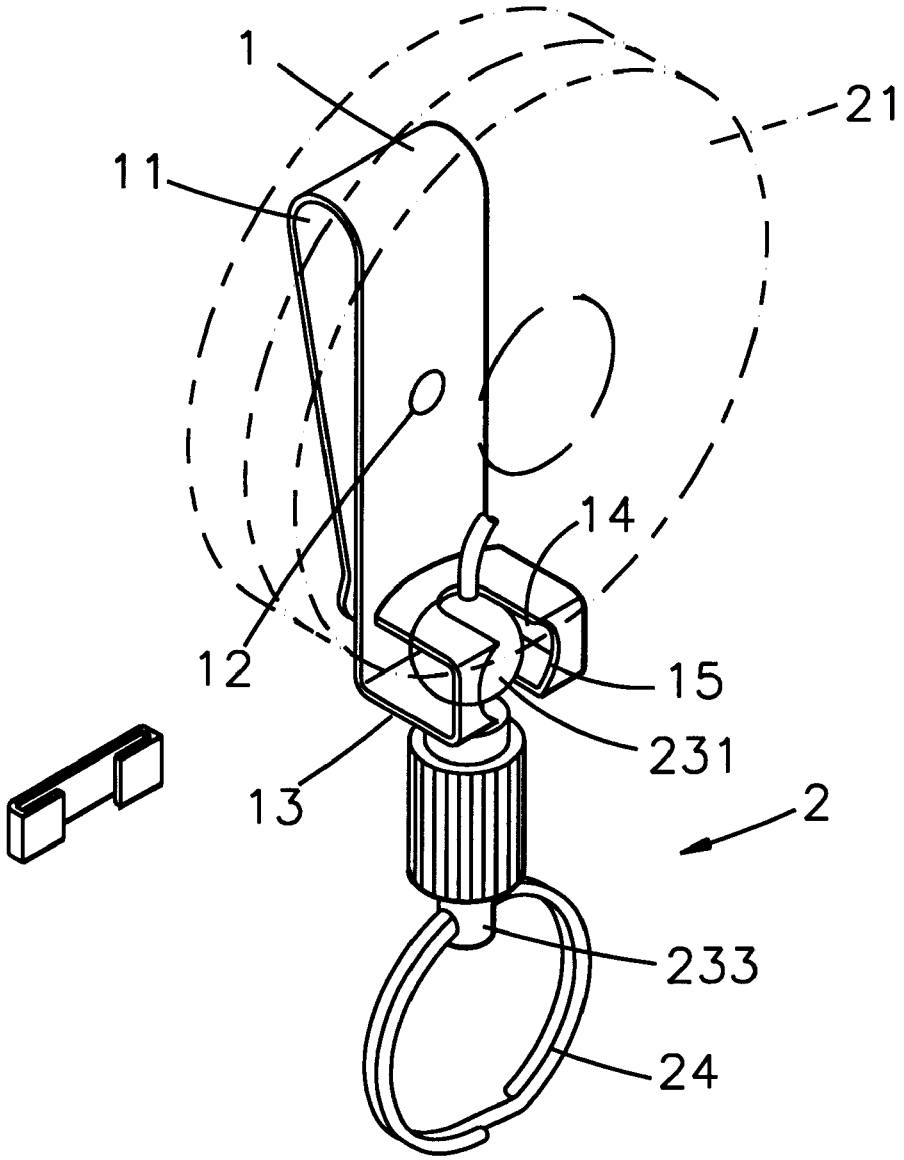
FIG. 7 is an exploded view of an alternate form of the extensible hanging device according to the present invention.
Figure 8:
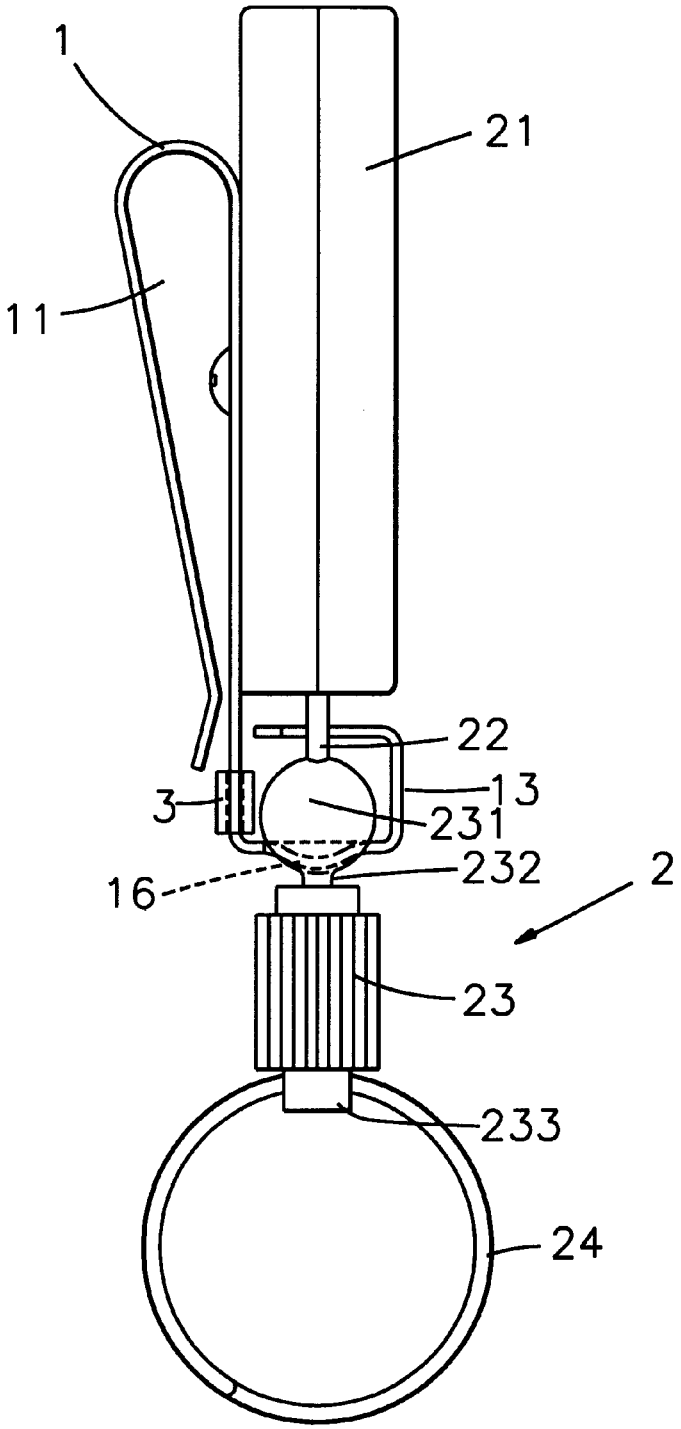
FIG. 8 is a side view of the alternate form of the extensible hanging device according to the present invention.
Figure 9:
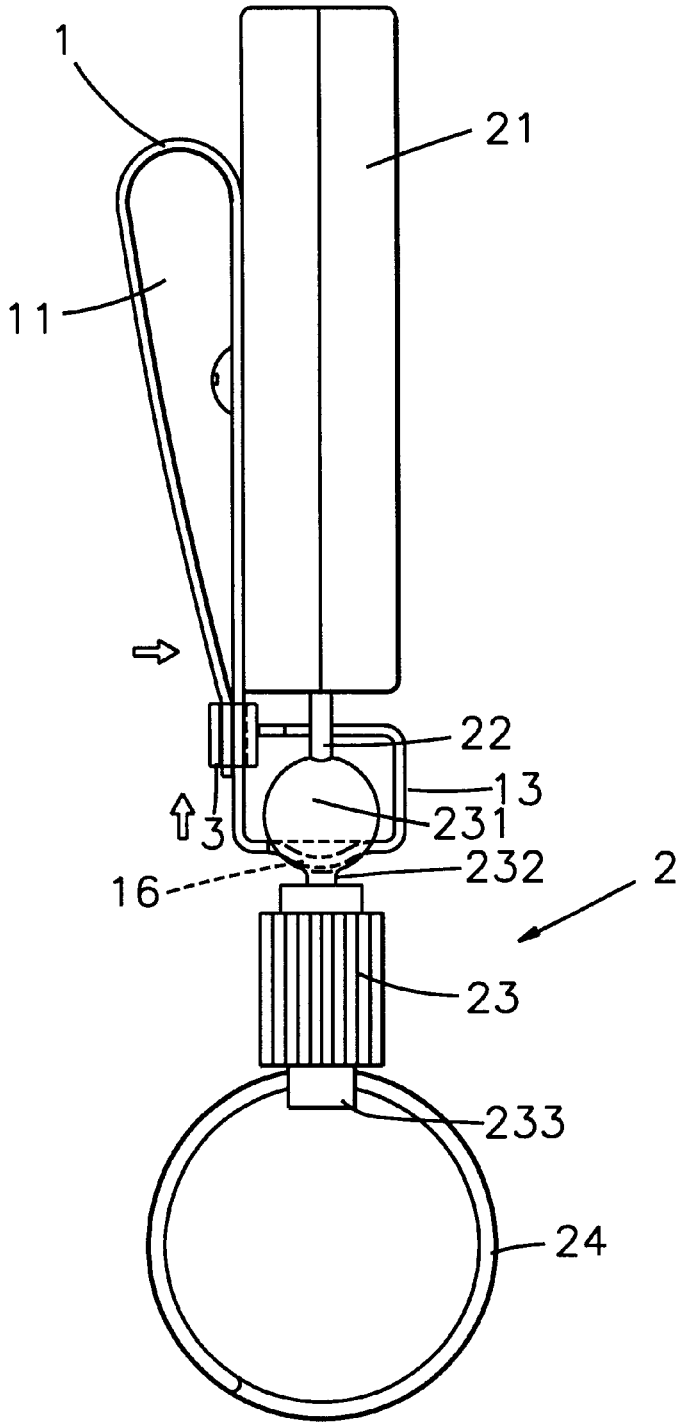
FIG. 9 is similar to FIG. 8 but showing the free end of the clamping plate secured to the retaining plate.

FIGS. 7 through 9 show an alternate form of the present invention. According to this alternate form, a springy retaining plate 3 is slidably coupled to the clip 1 below the mounting hole 12. When the clip 1 is fastened to for example a belt, the springy retaining plate 3 is squeezed and deformed with the hand, and then moved upwards and secured to the free end of the clamping plate 11, therefore the extensible hanging device is firmly secured to the belt.

It is to be understood that the drawings are designed for purposes illustration only, and are not intended as a definition of the limits and scope of the invention disclosed.

What the invention claimed is:

1. An extensible hanging device comprising a casing holding a winding mechanism on the inside, a cord member pulled in and out of said casing said cord member having an inner end connected to said winding mechanism and an outer end extended out a hole on said casing, a ring for holding personal items and a connector connected between said ring and the outer end of said cord member, wherein said connector comprises a spherical knob fixedly connected to the outer end of said cord member, said spherical knob having a neck, a clip is mounted on a back side wall of said casing for securing said casing to an object, said clip comprising a clamping plate at a back side thereof fastening, said clamping plate having a fixed end extended from a part of said clip and a free end, and a locating frame at a bottom side thereof for holding said spherical knob in place, said locating frame comprising a longitudinal narrow slot, which allows the neck of sail spherical knob to pass, and an expanded front opening which allows said spherical knob to pass and to be rested on the inside of said locating frame.

2. The extensible hanging device of claim 1 wherein said locating frame of said clip further comprises a recessed portion around a rear end of said longitudinal narrow slot on which said spherical knob is rested.

3. The extensible hanging device of claim 1 further comprising a deformable springy retaining plate coupled to and moved on said clip for scouring to the free end of said clamping plate.

* * * * *